United States Patent [19]

Clearman et al.

[11] 4,347,861

[45] Sep. 7, 1982

[54] DISHWASHER SOIL SEPARATOR

[75] Inventors: Jack F. Clearman; Vincent P. Gurubatham, both of St. Joseph, Mich.

[73] Assignee: Whirlpool Corporation, Benton Harbor, Mich.

[21] Appl. No.: 238,356

[22] Filed: Feb. 25, 1981

[51] Int. Cl.[3] ..... B08B 3/02

[52] U.S. Cl. ..... 134/104; 134/109; 134/186; 134/191

[58] Field of Search ..... 134/104, 109, 111, 176, 134/186, 191

[56] References Cited

U.S. PATENT DOCUMENTS

| | | | |
|---|---|---|---|
| 238,356 | 1/1907 | Kaehl | 233/10 |
| 2,254,127 | 8/1941 | Underwood | 366/265 |
| 2,321,887 | 6/1943 | Ayres | 233/20 |
| 3,542,594 | 11/1970 | Smith et al. | 134/104 X |
| 3,558,043 | 1/1971 | Smith et al. | 233/21 |
| 3,709,236 | 1/1973 | Field et al. | 134/104 |
| 4,004,600 | 1/1977 | Corn et al. | 134/176 X |
| 4,150,680 | 4/1979 | Johnson et al. | 134/104 |
| 4,168,715 | 9/1979 | Spiegel et al. | 134/104 |
| 4,243,431 | 1/1981 | Dingler et al. | 134/186 X |
| 4,319,599 | 3/1982 | Dingler et al. | 134/186 X |

FOREIGN PATENT DOCUMENTS

| | | | |
|---|---|---|---|
| 253225 | 11/1948 | Switzerland | 134/191 |

*Primary Examiner*—Robert L. Bleutge

*Attorney, Agent, or Firm*—Wegner, McCord, Wood & Dalton

[57] ABSTRACT

A centrifugal soil separator for use in dishwashers and the like. A portion of the dishwashing liquid being circulated during the dishwashing operation is directed against a housing wall portion of the soil separator to spin the separator at high speed. The separator defines a soil collecting portion to which soil pumped through the separator is directed so as to be separated from the dishwashing liquid. Pumping of the liquid through the separator is a function of the rotation of the separator. Washing liquid may be directed reversely through the separator upon completion of the washing cycle for washing out the collected soil from the separator and permitting it to be disposed of through the normal drain structure of the dishwasher. The separator may be rotated during the washing-out operation for improved automatic cleaning thereof.

24 Claims, 6 Drawing Figures

FIG. 1
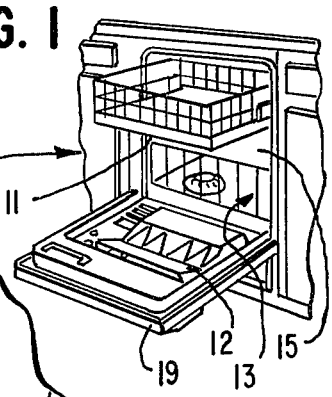
FIG. 3
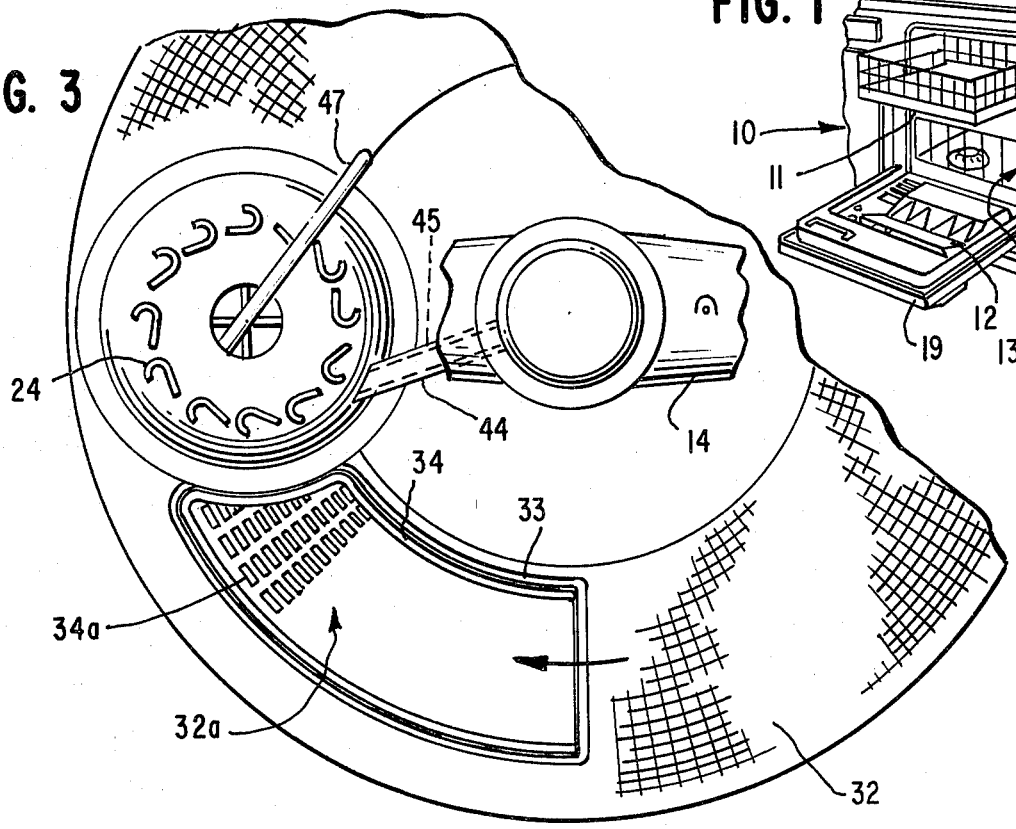
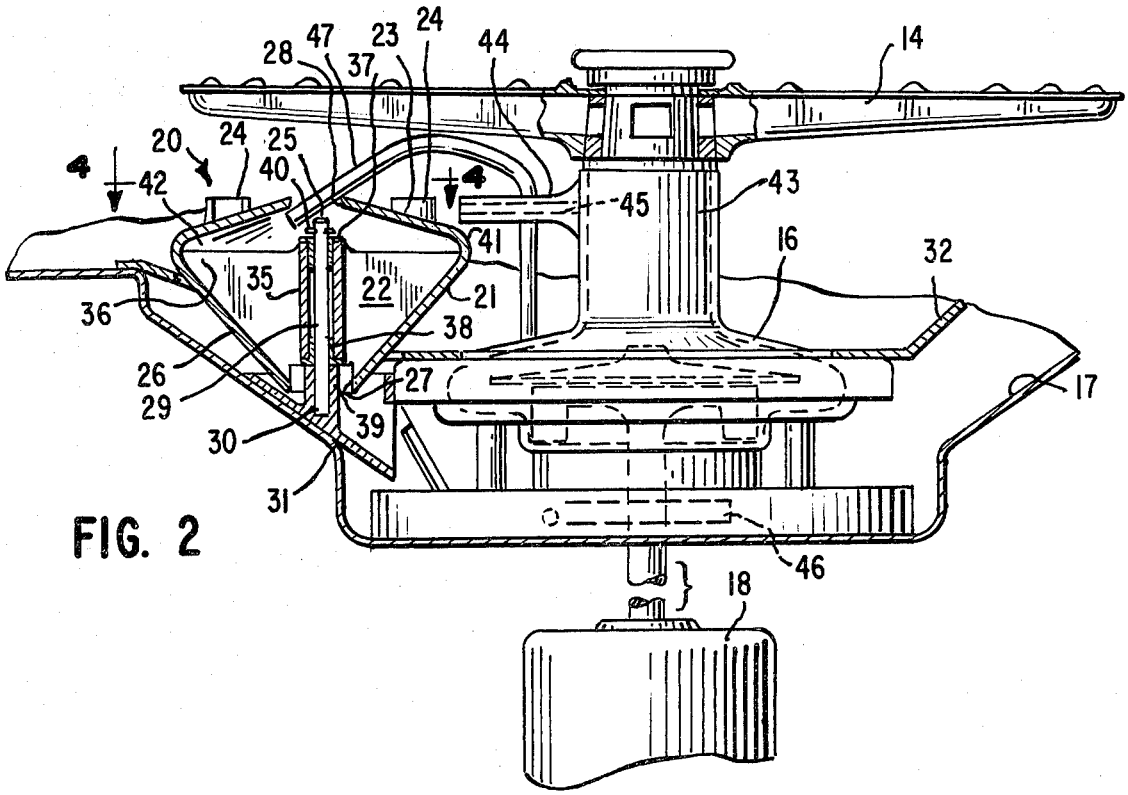
FIG. 2

DISHWASHER SOIL SEPARATOR

BACKGROUND OF THE INVENTION

1. Field of the Invention

This invention relates to dishwashing apparatus and in particular to soil separators for use in dishwashing apparatus.

2. Description of the Background Art

In U.S. Letters Pat. No. 4,150,680 of Philip P. Johnson et al, which patent is owned by the assignee hereof, a soil separator is shown for use in a dishwasher. The soil separator includes an accumulator wherein the soil is collected for subsequent discharge, and structure responsive to a centrifugal action in the suction passage leading to the recirculating pump of the dishwasher acting to bypass a portion of the returning dishwashing liquid to the accumulator for removal of the soil therefrom prior to recirculation of the liquid through the spray arm into the dishwashing chamber. A drain pump is connected to the accumulator for removing the collected soil.

Raymond W. Spiegel et al, in U.S. Letters Pat. No. 4,168,715, which patent is owned by the assignee hereof, disclose another form of soil separator for use in a dishwashing apparatus. The separator utilizes the combined swirling and longitudinal movement of the dishwashing liquid in the suction passage leading to the circulation pump for effecting soil separation by a centrifugal action. An accumulator is connected to two ports opening to the suction passage for effecting circulation of a portion of the dishwashing liquid through the accumulator wherein the soil is separated out.

An early centrifugal machine is shown in U.S. Letters Pat. No. 840,497, for use in separating starch, wheat, gluten and the like, from water and dissolved ingredients. A scraper is provided for scraping the inner face of the centrifugal drum so as to prevent choking of the outlets.

E. M. Underwood shows a revolving cone mixer in U.S. Letters Pat. No. 2,254,127 having a pair of cones for directing streams of liquid to meet each other at the center portion of the mixer.

In U.S. Letters Pat. No. 2,321,887, Arthur U. Ayres shows a centrifugal separator for separating solids from a liquid arranged to permit the solids to agglomerate to the circumference of the rotor under the influence of centrifugal force, and be removed peripherally from the rotor separately from the liquid.

In U.S. Letters Pat. No. 3,558,043, Harry E. Smith et al show an ore concentrator having a centrifugal vessel provided with a plurality of feed means extending through the base of the vessel. The feed means are rotatable with the rotation of the vessel and define a common feed inlet opening below the base and plural discharge openings within the vessel.

Thomas R. Field et al show, in U.S. Letters Pat. No. 3,709,236, a dishwasher having a spray arm arranged to separate waste particles centrifugally in the operation of the dishwasher.

In U.S. Letters Pat. No. 4,004,600 of Adolph D. Corn et al, which patent is also owned by the assignee hereof, a dishwasher is shown having a strainer screen closing the top of the sump to prevent large soil particles from entering the pump inlets.

SUMMARY OF THE INVENTION

The present invention comprehends an improved soil separator for use in a dishwasher wherein the separator is hydraulically rotated by directing a portion of the dishwashing liquid being circulated by the pump against the housing of the separator.

The housing is rotatably mounted on a support carried by a portion of the dishwasher structure so as to spin freely during the separating operation.

Reaction means are provided on the separator housing in the form of turbine elements reacting to the impinging stream of dishwashing liquid directed thereagainst to effect the desired high speed rotation of the separator.

The lower end of the separator defines an inlet opening in communication with dishwashing liquid to be cleaned such as in a sump portion of the dishwasher. Rotation of the housing effects a pumping of the dishwashing liquid upwardly through a pump chamber defined within the separator housing. The pumping action further imparts a swirling motion to the pumped dishwashing liquid so as to cause centrifugal separation of food particles and the like to an outer collecting space of the separator.

The cleansed dishwashing liquid passes outwardly from the top of the separator for circulation by the dishwasher pump through the spray arm of the dishwasher in effecting cleansing of dishes in a dishwasher.

Upon termination of the dishwashing cycle, an automatic self-cleansing of the soil separator is effected by suitably directing a stream of dishwashing liquid reversely through the soil separator against the collected soil therein so as to wash the collected soil outwardly through the lower inlet opening to be disposed of as by the drain pump means of the dishwasher.

In the illustrated embodiment, a portion of the liquid being pumped by the drain pump is directed inwardly through the upper outlet opening of the separator in effecting the self-cleaning operation.

During the cleaning operation, the separator housing is rotated to provide improved self-cleaning thereof.

More specifically, the invention comprehends an improved soil separator for use in a dishwasher including wall means defining a pump chamber having an inlet opening and an outlet opening spaced from the inlet opening, pump means in the chamber for pumping liquid from the inlet opening through the chamber and outwardly through the outlet opening as an incident of rotation of the wall means about an axis of rotation thereof, means for supporting the wall means for rotation about the axis of rotation, reaction means on the wall means arranged to be responsive to a liquid stream directed thereagainst for rotating the wall means about the axis, and collecting means responsive to rotation of the wall means for collecting soil from liquids being pumped through the chamber.

Means are provided for washing the collected soil from the collecting means and discharging the washed soil from the pump chamber for disposal thereof, and in the illustrated embodiment, the self-cleaning means comprise means for directing a stream of dishwashing liquid against the collected soil transversely to the pump chamber.

Thus, the soil separator of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawings wherein:

FIG. 1 is a fragmentary perspective view of a dishwashing apparatus having a soil separator embodying the invention;

FIG. 2 is a fragmentary vertical section of the dishwashing apparatus showing in greater detail the soil separator thereof;

FIG. 3 is a fragmentary top plan view of the apparatus of FIG. 2;

DESCRIPTION OF THE PREFERRED EMBODIMENT

Figure 4:
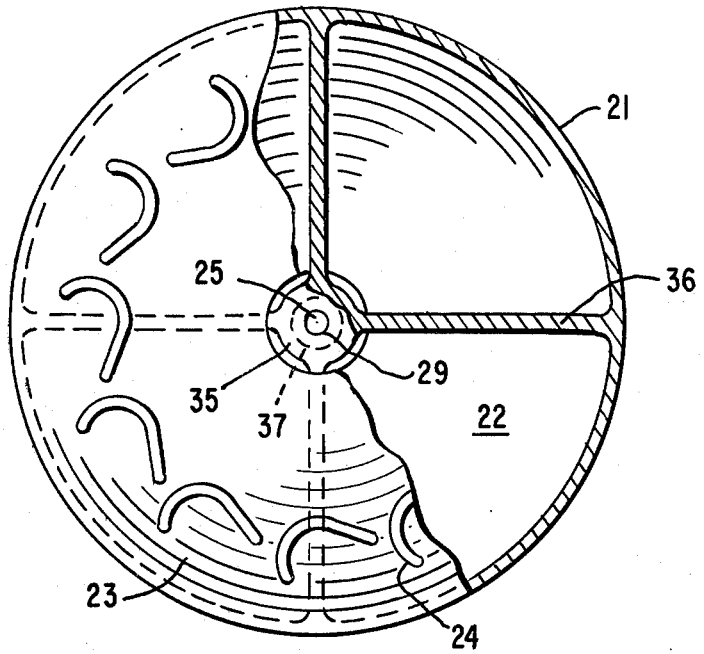
FIG. 4 is an enlarged horizontal section taken substantially along the line 4—4 of FIG. 2.

In the exemplary embodiment of the invention as disclosed in FIGS. 1 and 2, a dishwasher generally designated 10 includes a tub 11 selectively closed by a door 12 and having a lower portion 13. The dishwasher includes a spray arm 14 for spraying dishwashing liquid against dishes in a dishwashing space 15 defined by tub 11.

Dishwashing liquid is sprayed outwardly through spray arm 14 by means of a recirculation pump 16. The dishwashing liquid sprayed into washing space 15 is collected in a sump portion 17 of the tub for pumping by the recirculation pump 16. As shown in FIG. 2, the pump is driven from a suitable electric motor 18 under the control of the dishwasher electrical control 19 for effecting the desired dishwashing cycle of operation of the dishwasher.

In the normal dishwashing operation, soil particles, such as food particles, are entrained in the dishwashing liquid returned to sump 17. It is desirable to remove such soil particles from the dishwashing liquid before the dishwashing liquid is again directed against the dishes in the dishwashing space by the recirculating pump 16 through spray arm 14. The present invention is concerned with an improved soil separator structure 20 for continuously effecting such cleansing of the dishwashing liquid during the dishwashing cycle.

More specifically, as best seen in FIGS. 2 and 3, soil separator 20 is defined by wall means 21 forming a housing defining an internal pump chamber 22. On an upper portion 23 of the housing, the wall means define a plurality of reaction elements in the form of turbine blade elements 24 extending generally outwardly from the vertical axis 25 of the housing.

The lower portion of the housing defines an upwardly widening frustoconical lower portion 26 defining at its lower end an inlet opening 27. The upper portion 23 of the housing narrows frustoconically to define at its upper end an outlet opening 28 disposed coaxially of inlet opening 27.

Housing 21 is rotatably carried on a spindle 29 having its lower end 30 fixedly secured in a base support 31 mounted in any suitable manner in a sump 17 to extend vertically upwardly from the sump portion of the tub 11.

As seen in FIG. 3, a filter screen 32 covers sump 17 and defines a chute 32*a* for guiding dishwashing liquid from the lower portion 13 of the tub through the arcuate channel 33 and through a removable filter screen 34 to below the inlet 27 of the separator housing. Filter screen 34 has larger openings 34*a* than screen 32 such that larger particles of soil are washed into the proximity of inlet opening 27 while particles too large to pass through openings 34*a* are trapped for manual removal from screen 34. Thus, in normal operation, dishwashing liquid is present at inlet opening 27.

As best seen in FIGS. 2 and 4, the separator is provided with axial sleeve 35 which is mounted to the lower portion 26 of the housing 21 by a plurality of radially extending vanes or pump means 36. A spool hub 37 is installed in the upper portion of sleeve 35 and a second spool hub 38 is installed in the lower portion for rotatively mounting the separator on spindle 29.

As seen in FIG. 2, lower spindle hub 38 may rest slidably on an upstanding post portion 39 of the base support 31. A split ring 40 may be mounted to the upper end of the spindle for removably retaining the separator on the spindle.

Housing portions 26 and 23 are joined by an arcuate annular wall portion 41 defining a radially outermost collecting space 42 within pump chamber 22.

Figure 5:
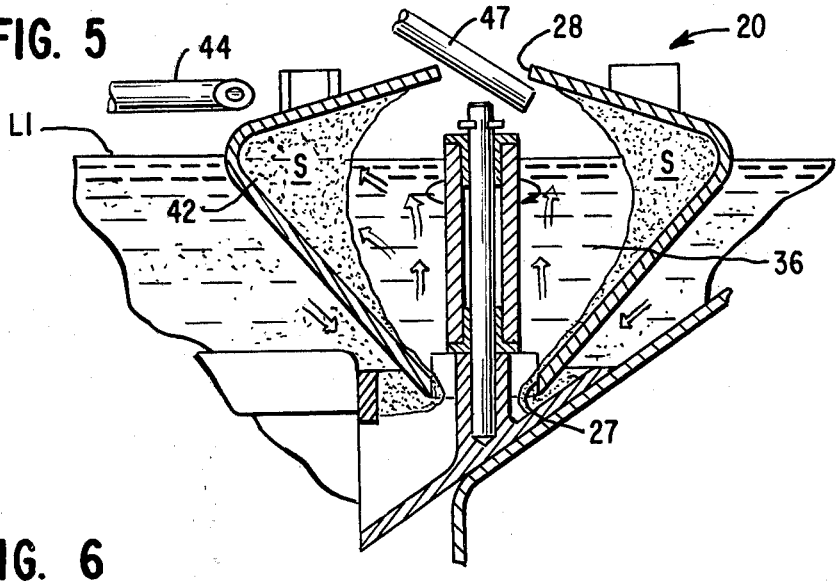
FIG. 5 is a vertical sectional diagram illustrating the soil collecting operation of the soil separator.

As seen in FIG. 2, dishwashing liquid is conducted from pump 16 to spray arm 14 through a conduit 43. A duct 44 extends outwardly from conduit 43 to define a flow passage 45 for conducting a portion of the pumped dishwashing liquid from conduit 43 through flow passage 45 against the reaction turbine element 24 of the soil separator. In reacting to the impinging dishwashing liquid stream, the turbine elements drive the soil separator at a relatively high velocity about axis 25. In the illustrated embodiment, the housing rotates at an illustrative speed of approximately 800 to 1200 rpm. Resultingly, as shown in FIG. 5, liquid is pumped by vanes 36 through inlet opening 27 and out opening 28 while soil particles S are thrown by centrifugal force outwardly into the collecting space 42 so at to be effectively separated from the upwardly pumped dishwashing liquid. This action is effected continuously during the dishwashing cycle as an automatic concomitant of the delivery of the dishwashing liquid from circulation pump 16 to spray arm 14.

Figure 6:
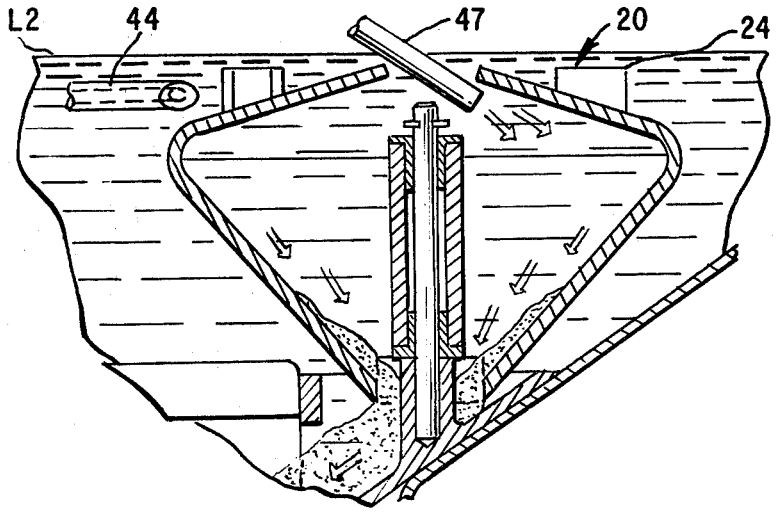
FIG. 6 is a vertical sectional diagram illustrating the removal of the collected soil from the soil separator in a self-cleaning operation.

Upon completion of the dishwashing cycle, pump 16 is reversed so as to effect a draining operation through a drain pump 46. The liquid level L2 (FIG. 6) at the beginning of the drain cycle is higher than the level L1 (FIG. 5), because during the dishwashing cycle some liquid is suspended within the dishwashing space 15 by recirculation pump 16. During such reverse operation of pump 16, dishwashing liquid continues to be delivered outwardly through duct 44 against the turbine blade elements 24 so as to continue rotation of the soil separator. At the same time, liquid is delivered from the drain pump 46 through a duct 47 extending through the outlet opening 28 of the soil separator and having a discharge end 48 directed toward the collecting space 42 within pump chamber 22. Thus, dishwashing liquid delivered through duct 47 at this time is directed against the soil collected in collecting space 42, washing the soil therefrom as illustrated in FIG. 6, so as to cause the washed soil to pass downwardly through the inlet opening 27 and, thus, to the sump for disposal by the drain pump 46 with the other dishwashing liquid in sump 17.

Thus, soil separator 20 provides a continuous cleansing of the dishwashing liquid during a dishwashing cycle by treating a portion of the dishwashing liquid in the dishwasher sump 17 so as to remove soil therefrom and return to the liquid in the sump 17 the cleansed liquid for recirculation through spray arm 14 in effecting further washing of the dishes in the dishwasher. The filter screens 32 and 34 remove relatively large particles from the dishwashing liquid as it passes into sump 17 and soil separator 20 removes the smaller particles passing through the filter screens.

The invention comprehends the provision of means for automatically hydraulically rotating the soil separator by utilization of a portion of the recirculating dishwashing liquid in effecting the desired centrifugal soil separation.

The invention comprehends an automatic self-cleansing of the soil separator at the termination of the dishwashing cycle by utilizing a portion of the liquid being pumped to drain and forcibly cleansing the interior of the soil separator while at the same time maintaining a rotation of the soil separator by utilization of a portion of the dishwashing liquid being circulated from pump 16 through the spray arm 14 during the drain cycle. Thus, the soil separation and soil separator cleansing functions are provided as automatic operations of the dishwasher without the need for additional drive means and the like.

The foregoing disclosure of specific embodiments is illustrative of the broad inventive concepts comprehended by the invention.

We claim:

1. A soil separator for use in a dishwasher, comprising:

wall means defining a pump chamber having an inlet opening and an outlet opening spaced from the inlet opening;

pump means in the chamber for pumping liquid from the inlet opening through the chamber and outwardly through the outlet opening as an incident of rotation of the wall means about an axis of rotation thereof;

means for supporting the wall means for rotation about said axis of rotation;

reaction means on the wall means arranged to be responsive to a liquid stream directed thereagainst for rotating the wall means about said axis; and collecting means responsive to rotation of said wall means for collecting soil from liquid being pumped through said chamber.

2. The soil separator of claim 1 wherein said reaction means comprises at least one turbine element extending outwardly away from said axis.

3. The soil separator of claim 1 wherein said reaction means comprises at leat one turbine element extending outwardly away from said axis adjacent an upper portion of the wall means.

4. The soil separator of claim 1 wherein said inlet opening is in a bottom portion of the wall means and said outlet opening is in a top portion of the wall means.

5. The soil separator of claim 1 wherein said inlet and outlet openings are disposed at said axis.

6. The soil separator of claim 1 wherein said collecting means is disposed within said pump chamber.

7. The soil separator of claim 1 wherein said collecting means comprises a radially outer, radially inwardly opening annular recess disposed within said pump chamber.

8. The soil separator of claim 1 wherein said pump means comprises at least one radial vane member.

9. The soil separator of claim 1 wherein said pump means comprises at least one radial vane member extending between the supporting means and said wall means.

10. The soil separator of claim 1 wherein the supporting means comprises a vertical fixed spindle, and means on said wall means for rotatably supporting the wall means on said spindle.

11. The soil separator of claim 1 wherein said inlet opening is disposed at the bottom of said pump chamber and said wall means widens frustoconically upwardly from said inlet opening.

12. A soil separator for use in a dishwasher having a circulation pump, a spray arm, conduit means for conducting washing liquid from the pump to the spray arm, and means defining a washing liquid collection sump, comprising:

wall means defining a pump chamber having a bottom inlet opening and a top outlet opening;

means in the chamber for pumping liquid from the inlet opening through the chamber and outwardly through the outlet opening as an incident of rotation of the wall means about an axis of rotation thereof;

means carried by said sump means for rotatably supporting the wall means for rotation about said axis;

reaction means on the wall means arranged to be responsive to a liquid stream directed thereagainst for rotating the wall means about said axis;

means within said chamber responsive to rotation of said wall means for collecting soil from liquid pumped through said chamber; and means for washing the collected soil from the collecting means and discharging the washed soil from said pump chamber for disposal thereof.

13. The soil separator of claim 12 wherein said conduit means includes means defining a flow passage for directing a portion of the washing liquid circulated by the pump against said reaction means for effecting said rotation of the wall means.

14. The soil separator of claim 12 wherein said means for washing the collected soil from the collecting means comprises means defining a flow passage for directing a portion of the washing liquid against the collected soil.

15. The soil separator of claim 12 wherein said means for washing the collected soil from the collecting means comprises means defining a flow passage for directing a portion of the washing liquid through said outlet opening against the collected soil, and the collected soil washed from the collecting means thereby flows from said pump chamber through said inlet opening.

16. The soil separator of claim 12 wherein said dishwasher includes means for selectively draining said sump, the discharged collected soil being delivered to said sump for disposal by said draining means.

17. The soil separator of claim 12 wherein said means for washing the collected soil from the collecting means comprises means defining a flow passage for directing a portion of the washing liquid through said outlet opening and transversely to the axial extent of said pump chamber against collected soil, and wherein the collected soil washed from the collecting means thereby flows from said pump chamber through said inlet opening.

18. The soil separator of claim 12 wherein said dishwasher includes drain pump means for selectively draining said sump, the discharged collected soil being delivered to said sump for disposal by said drain means, said drain pump providing washing liquid to said pump chamber to define said means for washing the collected soil from the collecting means.

19. In a dishwasher having a receptacle defining a dishwashing space and a liquid circulation pump including a pump outlet to said dishwashing space and a pump inlet, a soil separator comprising:

a hollow cup rotatively mounted within said space, said cup having wall means defining an inlet opening in liquid transfer communication with said pump inlet and defining an outlet opening in liquid transfer communication with said dishwashing space, said wall means further defining a soil collecting space between said inlet opening and said oulet opening within said hollow cup; and duct means having an inlet end hydraulically connected to said pump outlet and an outlet end adjacent said cup for hydraulically rotating said cup as an incident of said circulation pump circulating liquid through said pump outlet, soil in the liquid at said inlet opening being collected in said collecting space as a result of said hydraulic rotation of said cup.

20. The dishwasher structure of claim 19 wherein said cup includes at least one pump vane therein for pumping liquid from said inlet opening to said outlet opening through the hollow cup.

21. The dishwasher structure of claim 19 wherein said wall means defines reaction means on the exterior thereof for reacting to liquid directed thereagainst by said duct means to rotate said cup.

22. The dishwasher structure of claim 19 wherein said wall means defines reaction means on the exterior thereof for reacting to liquid directed thereagainst by said duct means to rotate said cup at a speed of at least approximately 800 rpm.

23. The dishwasher structure of claim 19 further including means for selectively washing the collected soil from the cup for disposal thereof.

24. The dishwasher structure of claim 19 wherein said cup includes at least one pump vane therein for pumping liquid from said inlet opening to said outlet opening through the hollow cup, said soil being urged centrifugally to said collecting space as a result of rotation of the cup as the liquid is pumped therethrough.

* * * * *